US008181775B2

(12) United States Patent
Bunn

(10) Patent No.: US 8,181,775 B2
(45) Date of Patent: May 22, 2012

(54) SPORTS EQUIPMENT HANGER

(76) Inventor: Joel W. Bunn, Johnstown, PA (US)

( * ) Notice: Subject to any disclaimer, the term of this patent is extended or adjusted under 35 U.S.C. 154(b) by 0 days.

(21) Appl. No.: 12/946,459

(22) Filed: Nov. 15, 2010

(65) Prior Publication Data

US 2011/0168587 A1 Jul. 14, 2011

Related U.S. Application Data

(60) Provisional application No. 61/282,283, filed on Jan. 13, 2010.

(51) Int. Cl.
*B65D 85/00* (2006.01)
*A45C 7/00* (2006.01)

(52) U.S. Cl. ..... 206/315.1; 206/466; 383/39

(58) Field of Classification Search ..... 206/315.1, 206/284, 286, 288, 287.1, 289, 466; 383/9, 383/38, 39, 22; 190/107; 211/118
See application file for complete search history.

(56) References Cited

U.S. PATENT DOCUMENTS 962,595 A * 6/1910 Smith ..... 211/88.01
2,526,575 A * 10/1950 Neal ..... 40/119
2,832,389 A * 4/1958 Smith ..... 383/9
4,164,968 A * 8/1979 Esposito et al. ..... 224/607
5,016,373 A * 5/1991 Theno ..... 40/594
5,121,833 A * 6/1992 Lindsay et al. ..... 206/6.1
5,141,113 A * 8/1992 Elliott ..... 211/85.2
D335,602 S * 5/1993 Magaard ..... D6/553
5,209,344 A * 5/1993 Smith ..... 206/6.1
5,238,307 A * 8/1993 Mooney et al. ..... 383/74
5,259,497 A * 11/1993 Brothers et al. ..... 206/6.1
D353,501 S * 12/1994 Kral ..... D6/513
D394,769 S * 6/1998 Flint ..... D6/513
5,779,033 A * 7/1998 Roegner ..... 206/6.1
D398,465 S * 9/1998 Wieder ..... D6/513
6,193,034 B1 2/2001 Fournier
D456,453 S * 4/2002 McCravy ..... D19/86
6,412,676 B1 * 7/2002 Stallings ..... 224/611
6,523,653 B2 2/2003 Roegner
6,948,599 B2 9/2005 Rodrigue et al.
7,059,073 B2 * 6/2006 Beach ..... 40/124
7,264,127 B2 * 9/2007 Jones ..... 211/118
7,278,539 B2 10/2007 Souza
D556,486 S * 12/2007 Boutin ..... D6/567
7,389,868 B2 * 6/2008 Lewand et al. ..... 206/6.1
2002/0074199 A1 6/2002 Albritton
2007/0119883 A1 * 5/2007 Albritton ..... 224/153
2008/0223677 A1 9/2008 Mauro
2010/0317470 A1 * 12/2010 Cea et al. ..... 473/570

* cited by examiner

*Primary Examiner* — Steven A. Reynolds
(74) *Attorney, Agent, or Firm* — Richard C. Litman

(57) ABSTRACT

The sports equipment hanger is a receptacle for storing and transporting sports gear or equipment. The receptacle includes a member fabricated from duck cloth. The member has opposed planar surfaces. A plurality of pockets, each constructed from open mesh material, is disposed on the opposed surfaces. Barrel locks are provided to close the pockets. A structure is attached to the top of the receptacle for hanging the receptacle when desired.

1 Claim, 4 Drawing Sheets

SPORTS EQUIPMENT HANGER

CROSS-REFERENCE TO RELATED APPLICATION

This application claims the benefit of U.S. Provisional Patent Application Ser. No. 61/282,283, filed Jan. 13, 2010.

BACKGROUND OF THE INVENTION

1. Field of the Invention

The present invention generally relates to receptacles, and more particularly to a sports equipment hanger for storing and transporting sports gear or equipment.

2. Description of the Related Art

Participation in sports such as hockey, football, etc. often requires the athlete to transport sports gear or equipment to and from the arena locker room and dressing area. The ubiquitous duffle bag has conventionally been the item of choice for transporting the sports gear. Unfortunately, the duffle bag has limitations that prevent it from being an ideal transporting and storing receptacle. Sports gear or equipment is usually crammed into the duffle bag in a disorderly array thereby preventing the athlete from quickly locating and extracting a particular piece of equipment. Since the walls of the conventional duffle bag are solid, placing damp equipment in the bag prevents drying; thereby creating a moist, malodorous environment that could lead to harmful bacterial growth and premature deterioration of some of the equipment. Furthermore, the design of the duffle bag prevents it from being hung in a manner that would allow for convenient packing and retrieval of sports equipment. Related art attempts to remedy these shortcomings have proven less than satisfactory. The sports world would certainly welcome a sports bag that would allow the bag to be hung in a convenient manner while permitting efficient storage, retrieval and air-drying of equipment. Thus, a sports equipment hanger solving the aforementioned problems is desired.

SUMMARY OF THE INVENTION

The sports equipment hanger is a receptacle for storing and transporting sports gear or equipment. The receptacle comprises a member fabricated from duck cloth. The member is provided with opposed planar surfaces. A plurality of pockets, each constructed from open-mesh material, is disposed on the opposed surfaces. Barrel locks are provided to close the pockets. A structure is attached to the top of the receptacle for hanging the receptacle when desired.

Accordingly, the invention presents a unique, convenient storing and transporting receptacle that is fashioned with open-mesh pockets. The open mesh pockets permit visual inspection of packed sports gear, thereby reducing the chances of omitting key equipment items. The open mesh pockets also permit air-drying of damp equipment stored therein. The receptacle is fabricated from rugged material and is lightweight. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
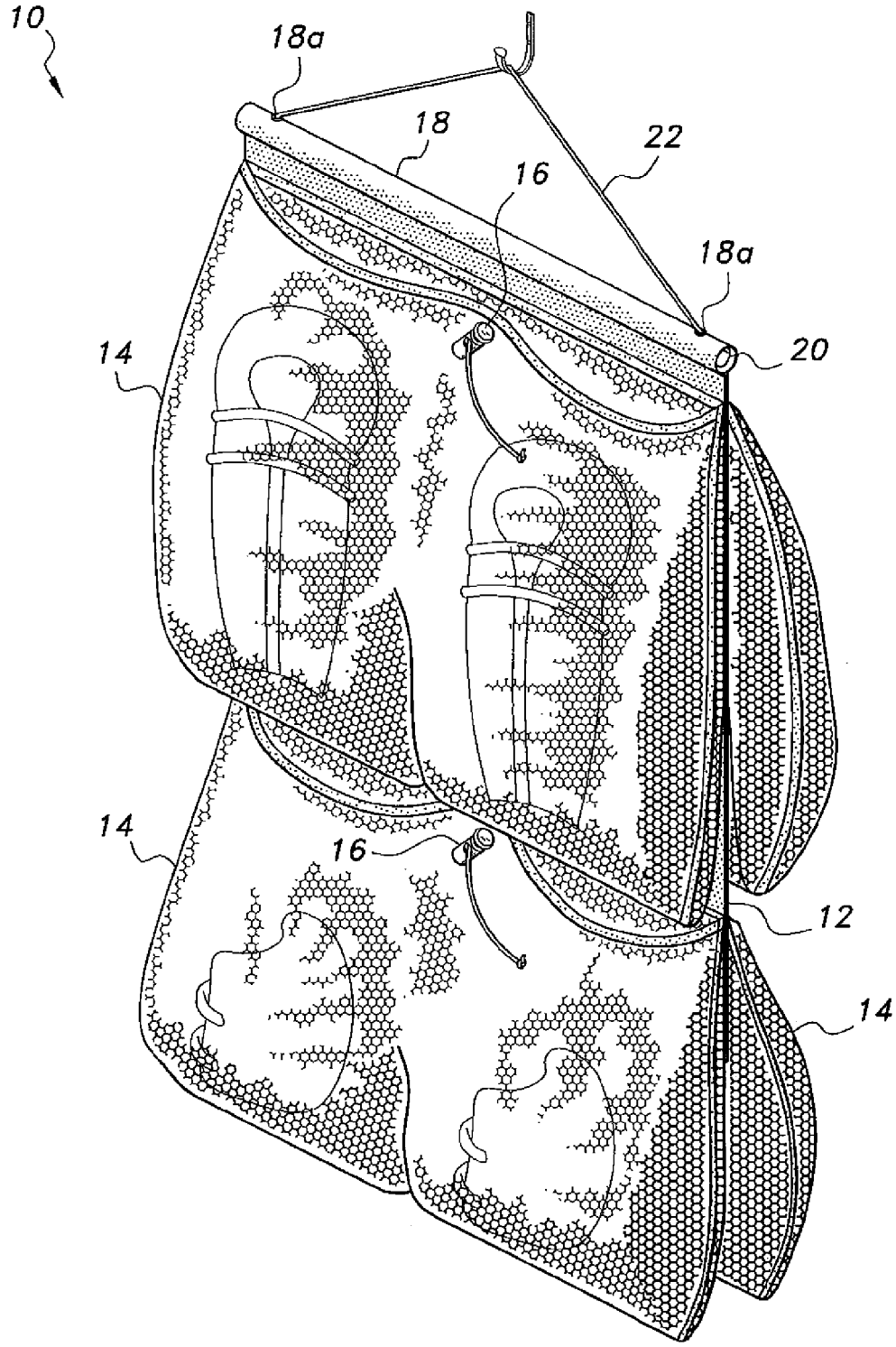
FIG. 1 is an environmental, perspective view of a sports equipment hanger according to the present invention.
Figure 2:
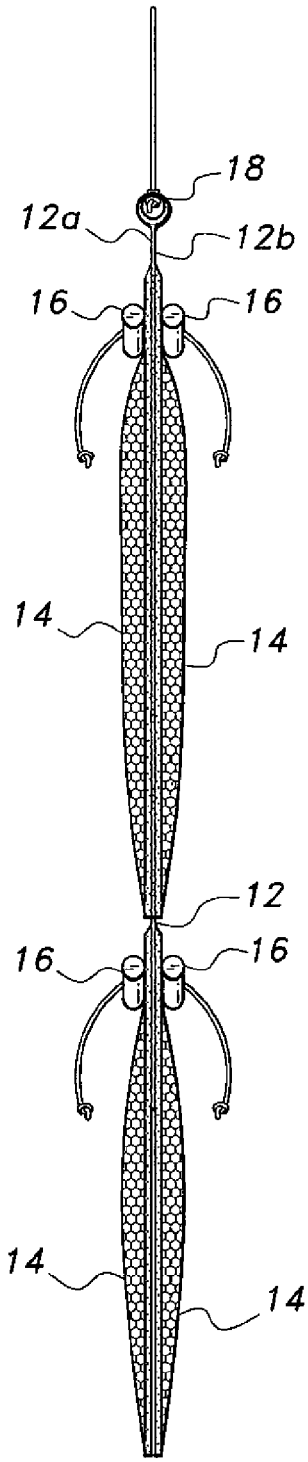
FIG. 2 is a side view of a sports equipment hanger according to the present invention.
Figure 3:
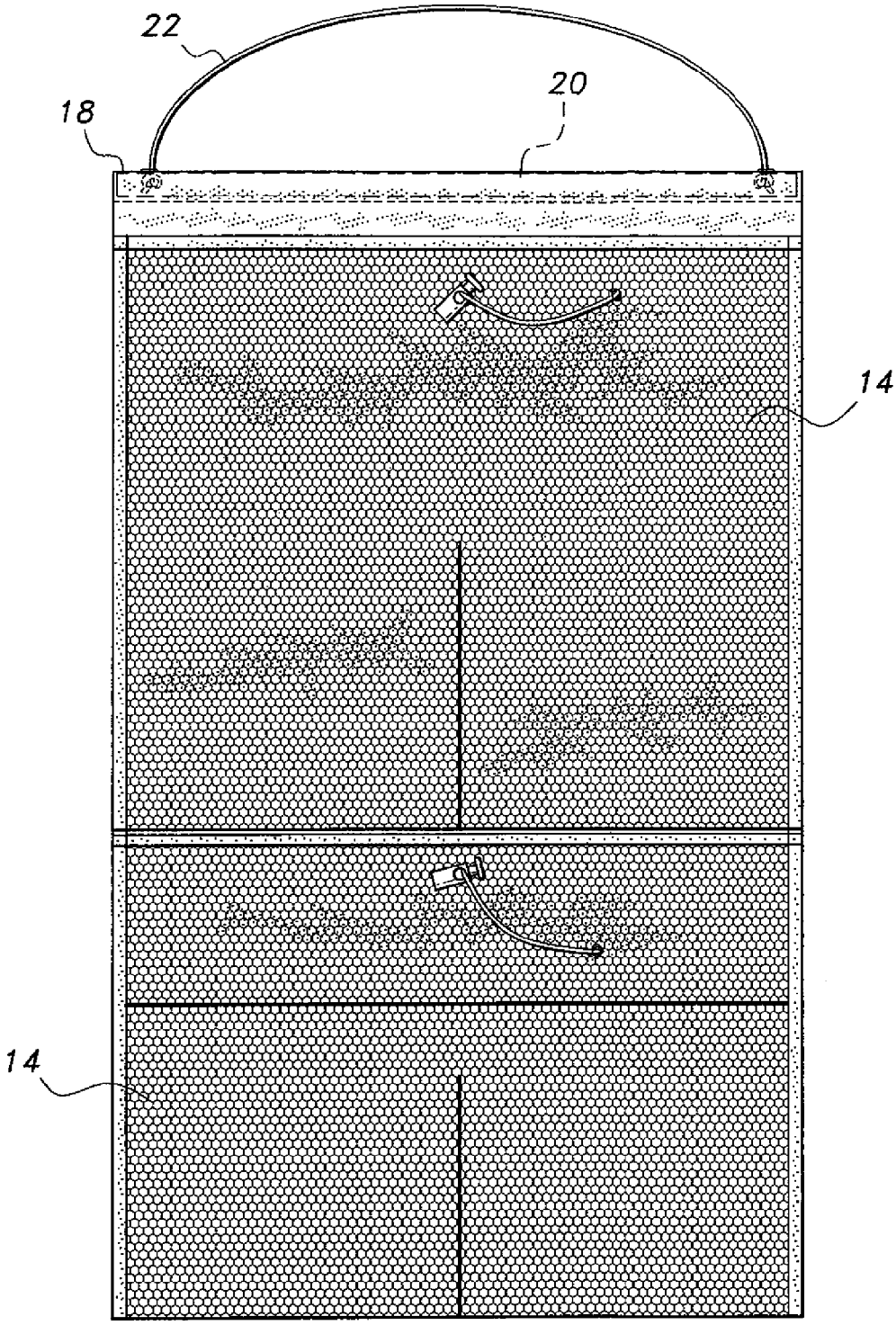
FIG. 3 is a front view of a sports equipment hanger according to the present invention.

Referring to FIGS. 1-3, the sports equipment hanger 10 comprises an elongate, rectangular member 12 having opposed planar surfaces 12*a* and 12*b*. Preferably, the member 12 is fabricated from a rugged and durable material, such as duck cloth. It should be noted, however, that other and different materials may be utilized, if suitable. Open mesh pockets 14 are arranged and attached on the planar surfaces 12*a* and 12*b*. As presently contemplated, at least two pockets are positioned on each planar surface. It should be noted that more than two pockets may be employed, if desired. The pockets 14 can be made of different sizes, depending on the type and dimensions of sports gear to be stored and transported therein. The open-mesh pockets 14 are also fabricated from a rugged and durable material. Each pocket 14 is provided with a respective barrel lock closure member 16, whereby the pockets 14 may be efficiently opened or closed, as desired.

A tubular appendage 18 is attached at the top end of the member 12. The appendage 18 encapsulates an elongate rod member 20 therein. To enhance stability when hanging, both appendage 18 and rod member 20 are coextensive with the width of member 12. Openings 18*a* are formed through the appendage 18 adjacent each end thereof for receiving the ends of a flexible cord 22 therethrough. The ends of the cord 22 are attached to the rod member 20 adjacent respective ends thereof to thereby form a mechanism or flexible loop for hanging the sports equipment hanger 10 when desired.

Figure 4:
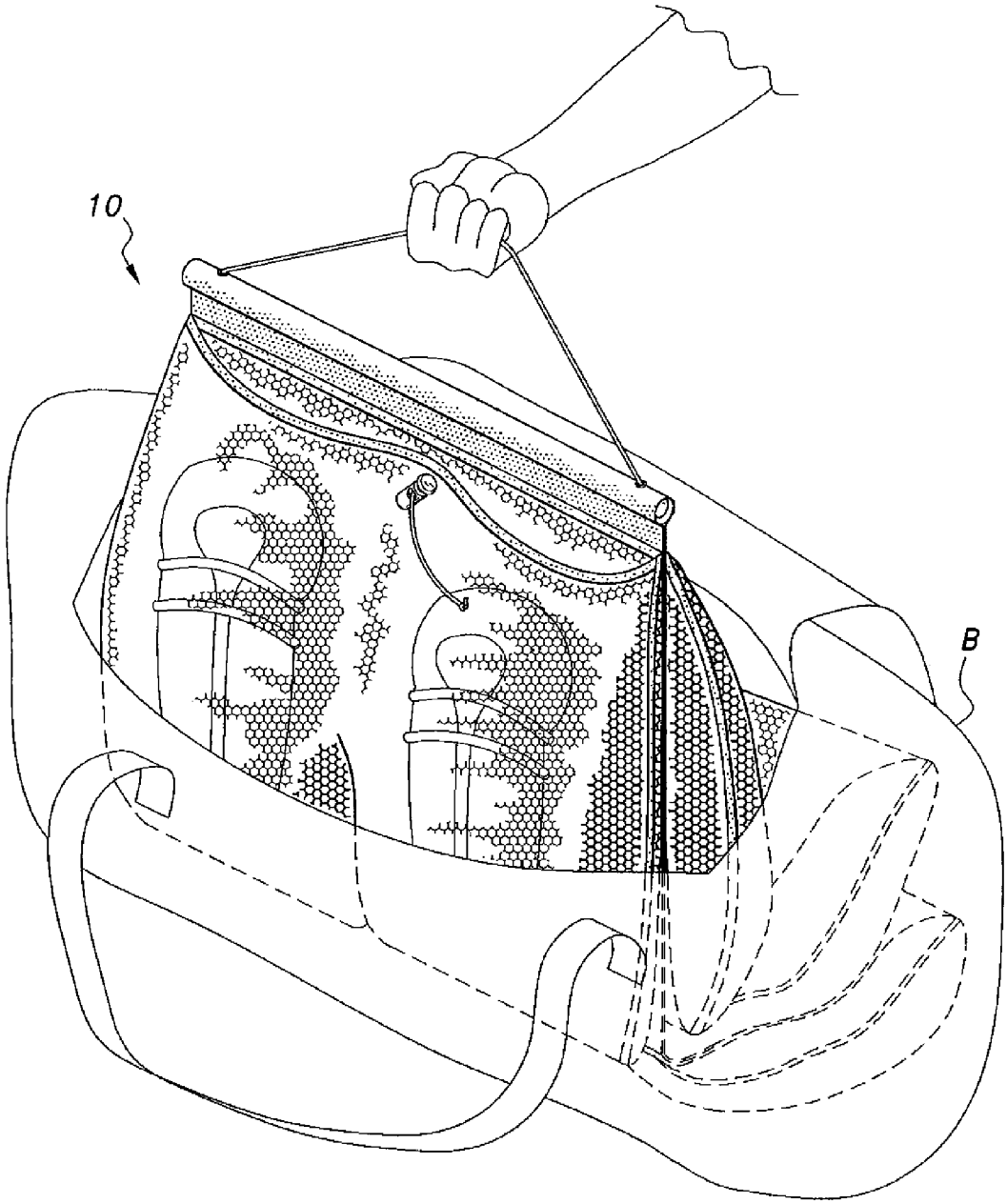
FIG. 4 is a partial view a sports equipment hanger according to the present invention, shown folded for packing.

As best seen in FIG. 4, the hanger 10 is easily folded for storage in a larger carrying bag B when necessary.

It is to be understood that the present invention is not limited to the embodiment described above, but encompasses any and all embodiments within the scope of the following claims.

I claim:

1. A sports equipment hanger, consisting of:

an elongate member having an upper end, a lower end, and opposed planar surfaces, the elongate member being fabricated from duck cloth;

a plurality of open mesh pockets disposed on each of the opposed planar surfaces and defining at least an upper row and a spaced apart lower row of open mesh pockets, wherein each of the open mesh pockets are coextensive with a corresponding open mesh pocket on the opposed planar surface and further including a corresponding barrel lock attached to each of said pockets, respectively, whereby the hanger is adapted to be folded about the upper and lower rows;

a tubular appendage extending across the upper end of the elongate member, the tubular appendage having a first end, a second end, and openings formed therein adjacent the first end and the second end;

an elongate rod disposed in the tubular appendage; and a flexible cord having opposing ends extending through the openings in the tubular appendage, the cord ends being attached to the elongate rod.

* * * * *